US007681735B2

(12) United States Patent
Youell, Jr.

(10) Patent No.: US 7,681,735 B2
(45) Date of Patent: Mar. 23, 2010

(54) SELF-LOCKING PALLET ASSEMBLY

(76) Inventor: Donald R. Youell, Jr., 8252 Davington Dr., Dublin, OH (US) 43017

( * ) Notice: Subject to any disclaimer, the term of this patent is extended or adjusted under 35 U.S.C. 154(b) by 470 days.

(21) Appl. No.: 11/397,762

(22) Filed: Apr. 4, 2006

(65) Prior Publication Data

US 2007/0227936 A1 Oct. 4, 2007

(51) Int. Cl.
*B65D 19/20* (2006.01)

(52) U.S. Cl. ..... 206/600; 206/599; 206/386; 108/51.3

(58) Field of Classification Search ..... 206/386, 206/600, 503, 598, 599, 596; 108/51.3
See application file for complete search history.

(56) References Cited

U.S. PATENT DOCUMENTS 3,557,719 A * 1/1971 Gielas ..... 108/51.3
3,904,105 A * 9/1975 Booth ..... 206/600
3,995,736 A * 12/1976 Lawson et al. ..... 206/596
4,085,847 A * 4/1978 Jacalone ..... 206/600
4,697,699 A * 10/1987 Schneider ..... 206/600
4,785,957 A * 11/1988 Beck et al. ..... 206/600
4,875,419 A * 10/1989 Helton et al. ..... 108/51.3
4,930,632 A * 6/1990 Eckert et al. ..... 206/386
5,111,937 A * 5/1992 Schutz ..... 206/386
5,441,154 A * 8/1995 Youell, III ..... 206/599
5,531,165 A * 7/1996 Taravella et al. ..... 108/51.3
5,918,744 A * 7/1999 Bringard et al. ..... 206/596
5,934,474 A * 8/1999 Renninger et al. ..... 206/600
6,050,410 A * 4/2000 Quirion ..... 206/386
6,070,726 A * 6/2000 Graham ..... 206/386
6,112,672 A * 9/2000 Heil ..... 108/55.3

* cited by examiner

*Primary Examiner*—Ehud Gartenberg
*Assistant Examiner*—Andrew Perreault
(74) *Attorney, Agent, or Firm*—Mueller Smith & Okuley, LLC

(57) ABSTRACT

A paperboard container is formed from a base unit, a flat floor unit, a self-supporting side unit, and a lid. The side unit is foldable inside the base unit for shipping and storage. The side unit can be unfolded and the parts readily assembled to form a paperboard container.

5 Claims, 6 Drawing Sheets

FIG. 6
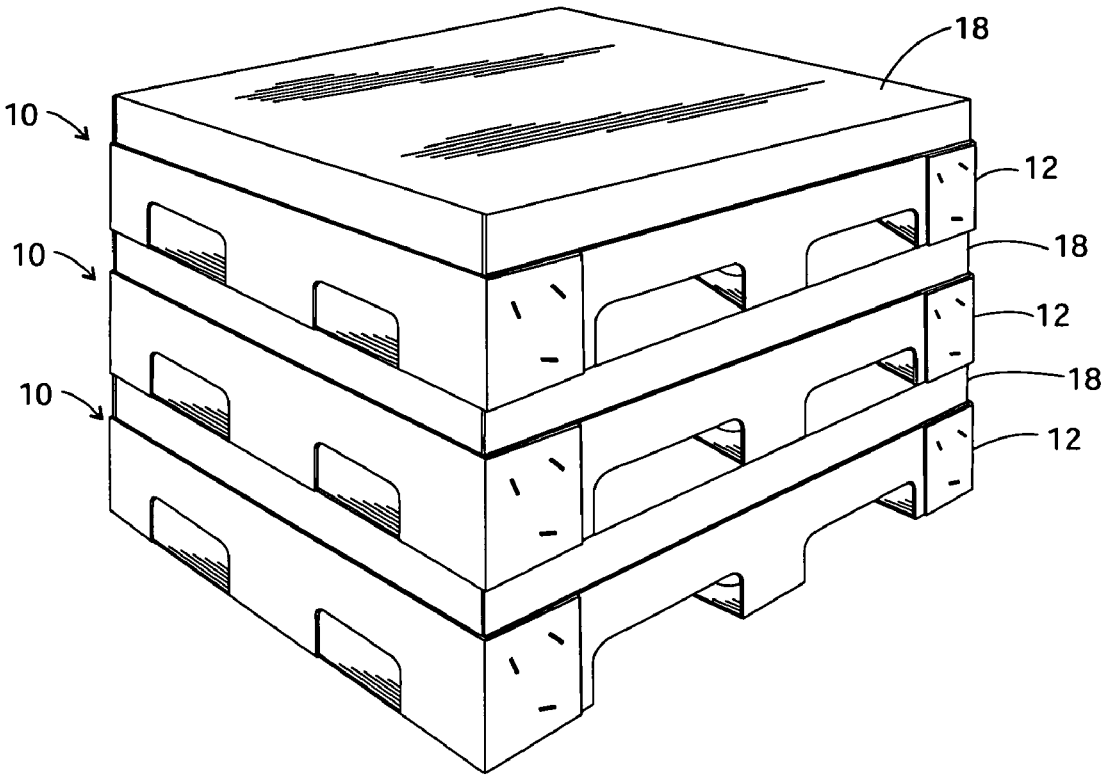
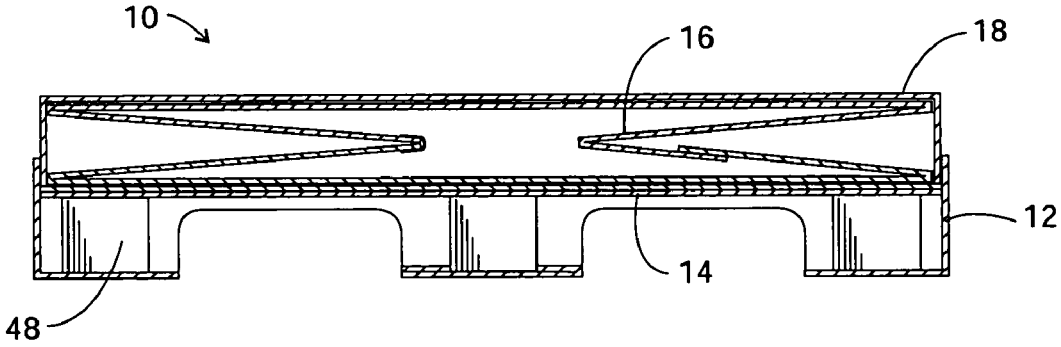
FIG. 7

SELF-LOCKING PALLET ASSEMBLY

CROSS-REFERENCE TO RELATED APPLICATIONS

None

STATEMENT REGARDING FEDERALLY SPONSORED RESEARCH

Not applicable.

BACKGROUND OF THE INVENTION

The present invention relates generally to paperboard containers and pallets, and more particularly to an integrated paperboard container and pallet system having a collapsible walled section facilitating the shipping of the system when unassembled.

Heretofore, pallets used by the shipping industries for the storage or transportation of a variety of goods generally have been constructed out of a wood material. These wooden pallets, however, are known to have a definite usable life, and, thereafter, must be disposed of in an acceptable manner such as in a landfill or the like. Increasingly, the use of wooden pallets has become an environmental issue as the amount of usable landfill space continues to decline. The disposal problem is magnified when it is considered that large assembly plants, such as automobile plants and the like, generated literally thousands upon thousands of wooden pallets.

The art, then, has turned to pallets fabricated of paperboard materials such as corrugated cardboard and the like, which are generally considered to be more recyclable than wood. Paperboard pallets of such a type are described in U.S. Pat. No. 5,222,444, and in U.S. Pat. No. 5,441,154.

In view of the foregoing, it is apparent that alternatives to the banded containers heretofore known in the art would be well received by the shipping and manufacturing industries. A preferred alternative would incorporate the advantages of the paperboard pallets described hereinbefore in being inexpensive, recyclable, and easy to assembly, and desirably would be collapsible for efficient storage and shipment.

BRIEF SUMMARY OF THE INVENTION

A paperboard container has a base unit having leg receiving recesses and openings adapted to be filled with forks from a forklift for conveying of the paperboard pallet assembly. A rectilinear flat floor unit has downward projecting legs that mate with the base unit leg receiving recesses and having corner tab recesses. A self-supporting side unit of rectilinear configuration has an open top adapted to receive a lid, an open bottom, and four sidewalls. The sidewalls at the open bottom have projecting corner tabs for mating with the floor unit tab recesses. The side unit has two longitudinal ends and fold lines adapted to be affixed for forming the rectilinear configuration and to urge the side unit to be self-supporting. Two opposing sidewalls of the side unit are foldable to collapse the side unit so that each non-folded sidewall can be laid down atop the flat floor unit for shipping and storage of said paperboard container. A lid covers the self-supporting side unit at its open top.

Advantages of the present invention include a paperboard pallet assembly in a folded down state where several such assemblies can be stacked for shipment. Another advantage is a paperboard pallet assembly that can be quickly and easily assembled at the plant. A further advantage is a paperboard pallet assembly that is sturdy and reliable for housing parts and goods for shipment. These and other advantages will be readily apparent to those skilled in the art based in the present disclosure.

BRIEF DESCRIPTION OF THE DRAWINGS

For a fuller understanding of the nature and advantages of the present invention, reference should be had to the following detailed description taken in connection with the accompanying drawings, in which:

FIG. 6 is a perspective view of 3 inventive self-locking pallet assemblies in compressed, shipping condition shown stacked atop each other;

FIG. 7 is a side sectional view of one of the compressed inventive self-locking pallet assemblies of FIG. 6;

The drawings will be described in further detail below.

DETAILED DESCRIPTION OF THE INVENTION

The inventive self-locking pallet assembly can be shipped and stored in a folded (compacted) state that permits several such assemblies to be stacked on top of each other. Thereafter, a worker can easily unfold the carton sides and assemble the container components to form a carton container suitable for shipping a variety of goods.

Figure 1:
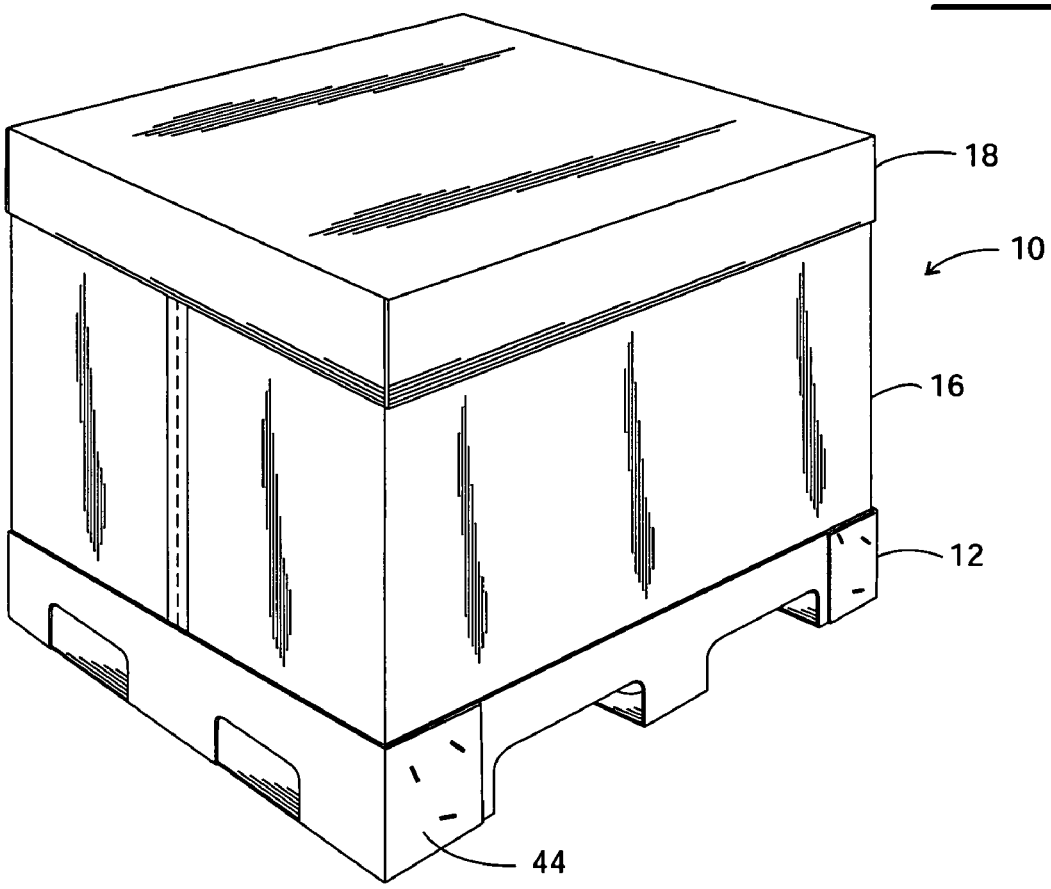
FIG. 1 is a perspective view of the inventive self-locking pallet assembly.
Figure 3:
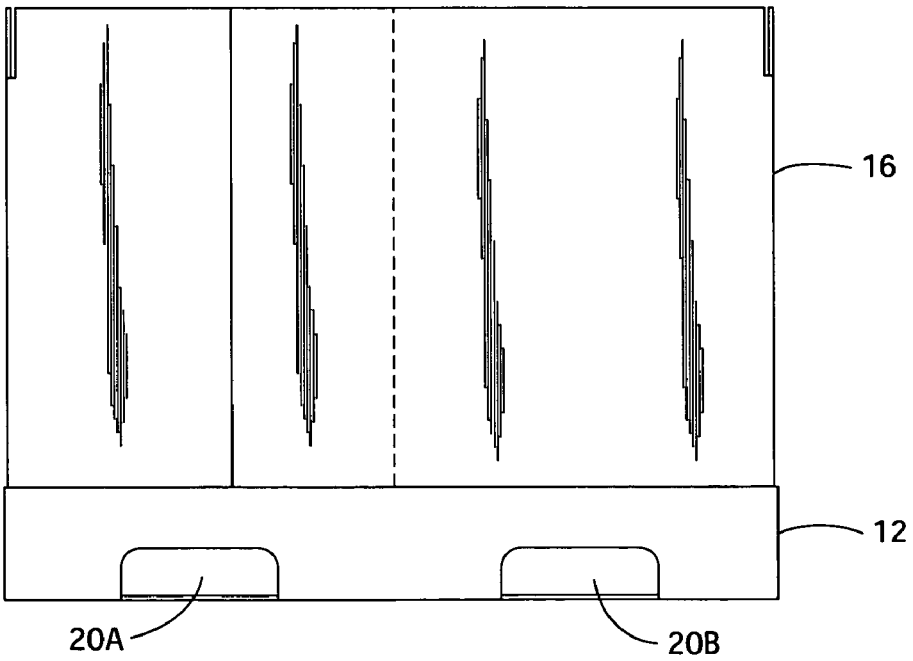
FIG. 3 is a side view of the self-locking pallet assembly.
Figure 2:
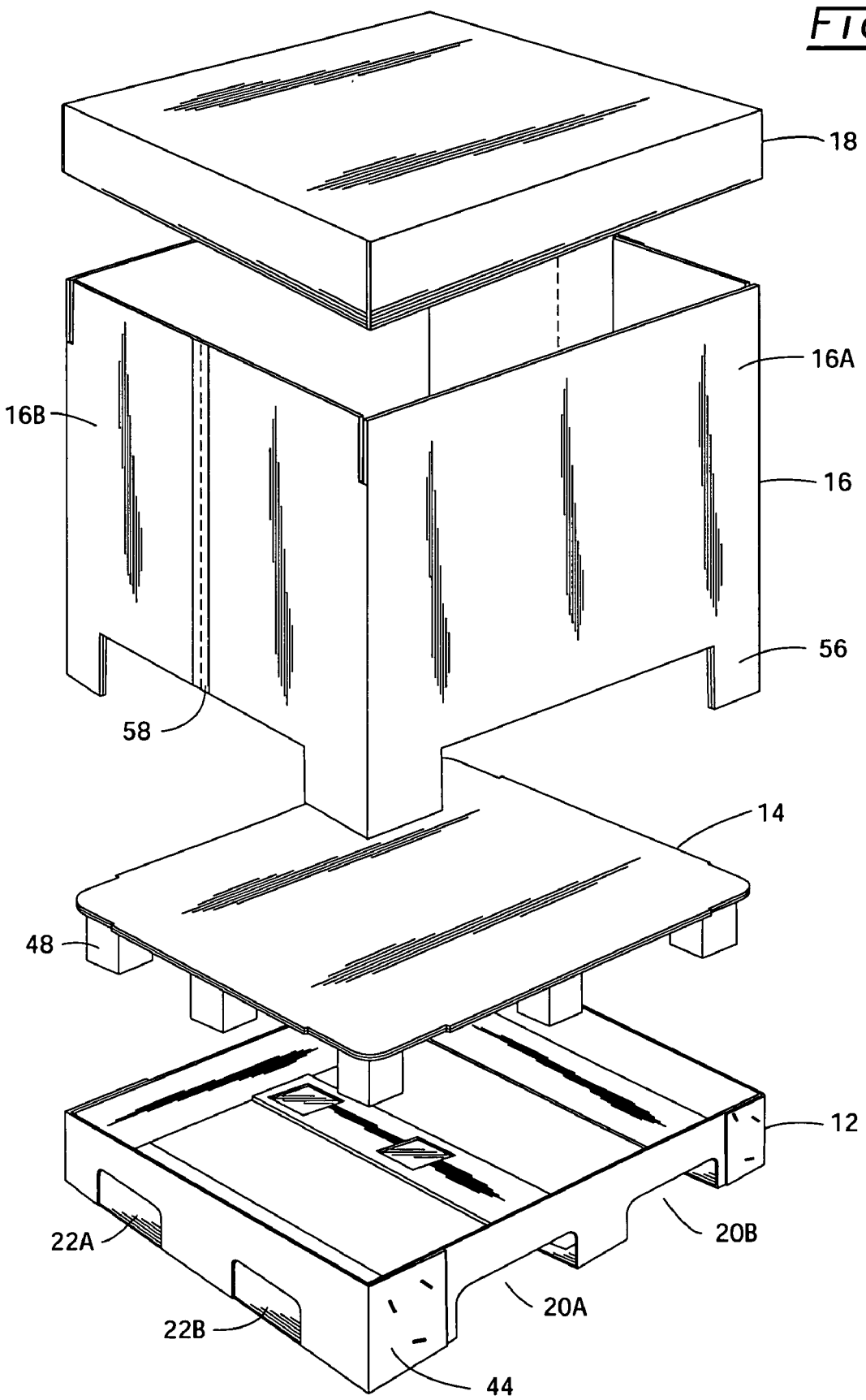
FIG. 2 is an exploded perspective view of the self-locking pallet assembly showing its individual components.

Referring initially to FIGS. 1 and 2, the inventive pallet assembly, 10, is seen to include a base unit, 12; a flat floor unit, 14; a side unit, 16; and a lid, 18. These components will be described in detail below along with their assembly. Materials of construction for forming the self-locking pallet assembly of the present invention can be a paperboard or corrugated paperboard material, such as, for example, cardboard, pasteboard, fiberboard, or the like. However, any recyclable material having the necessary strength and rigidity for the particular application envisioned is suitable. As to the preferred paperboard materials, it will be appreciated that the wall construction thereof, i.e., single-ply, double-ply, or higher, may be varied depending upon the application. The invention will be described in particular reference to the use of corrugated paperboard; however, such description is illustrative and not a limitation on the present invention.

Figure 10:
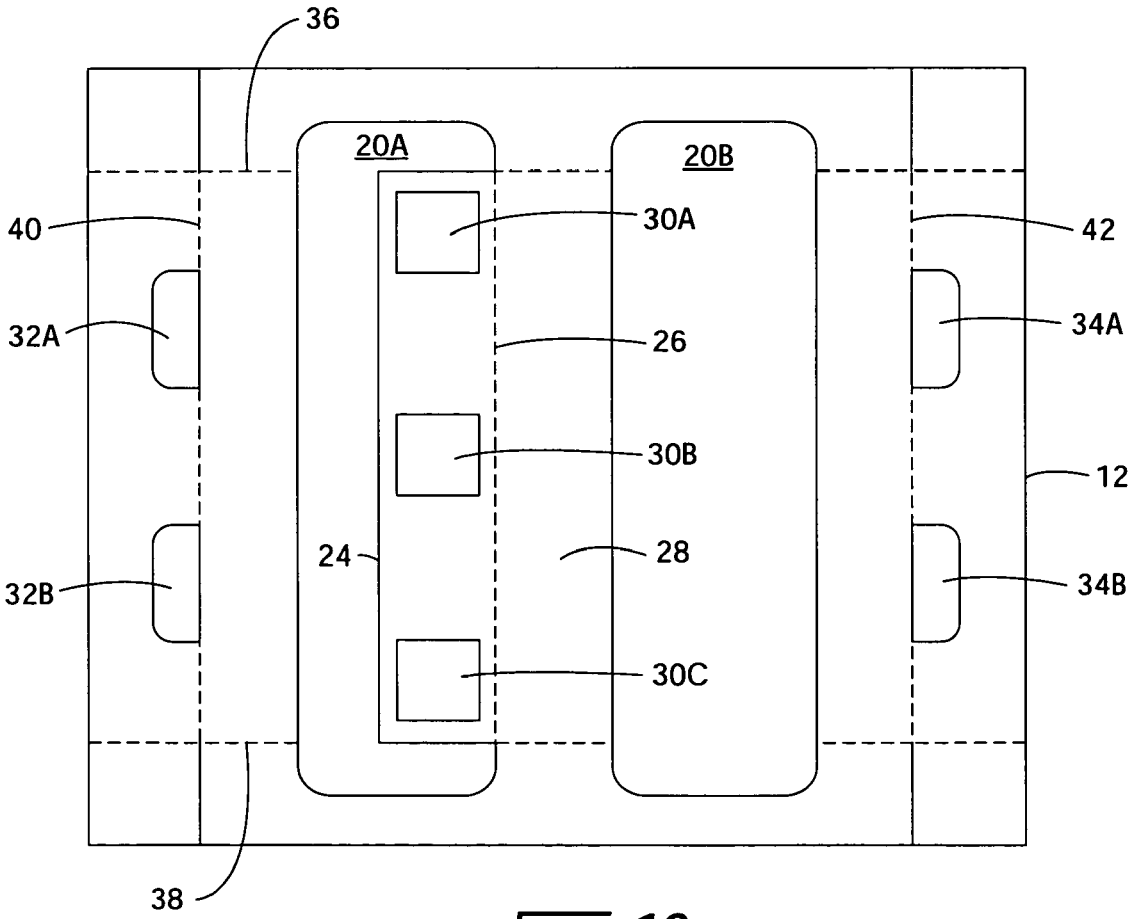
FIG. 10 is a plan view of the base unit in unfolded state showing fold lines in dotted form.

Base unit 12 has two pairs of tunnels, 20A/20B (see FIG. 10) and 22A/22B, through which the forks of a forklift can be placed for picking up pallet assembly 10 for its movement. The size and placement of such tunnels matches the forklift forks. Referring also to FIG. 10, base unit 12 can be formed form die-cut flat paperboard stock, as illustrated in FIG. 10. A flap, 24, is folded along a fold line, 26, to line atop a central neck, 28, to form a double layer central section having openings, 30A, 30B, and 30C. Of course, the number of openings could be greater or less than the number shown in the drawings. Die-cut openings, 32A/32B and 34A/34B, form tunnels 22A and 22B.

To assemble base unit 12, the paperboard material is folded along fold lines, 36, 38, 40, and 42. Stapling of ends, as illustrated in FIG. 1, as at an end, 44, completes the assembly of base unit 12.

Figure 9:
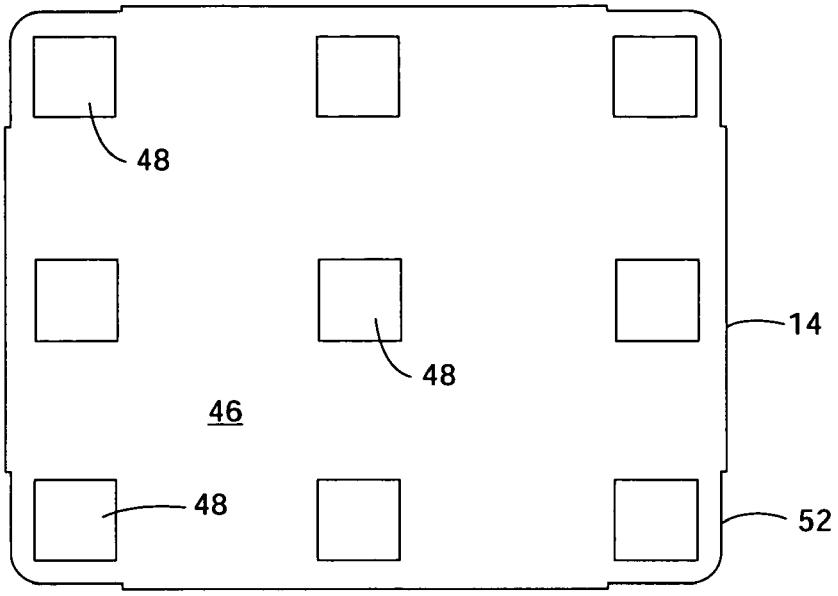
FIG. 9 is a bottom plan view of the floor.

Referring now to FIGS. 2 and 9, flat floor unit 14 is formed from a piece of flat paperboard stock, 46, to which are attached a plurality of legs exemplified by a leg, 48, which are honeycomb in construction. While nine such legs are illustrated in the drawings, the skilled artisan will appreciate that a greater or lesser number of legs will suffice for the inventive pallet assembly. The central legs are configured for fitting into recesses 30A-C in base unit 12. No adhesive or other securement augmentation need be used between the legs and recesses; although, their use certainly is possible. Also, while leg 48 and the other legs are shown square in shape, other configurations, e.g., cylindrical, certainly also could be used.

Flat floor unit 14 has a series of recesses, recesses 50 and 52 being exemplary of such recesses. The number and location of the recesses also can be varied from the drawings and still be with the precepts of the present invention. The purpose of these recesses will be explained in connection with the further detailed description of side unit 16, below.

Figure 4:
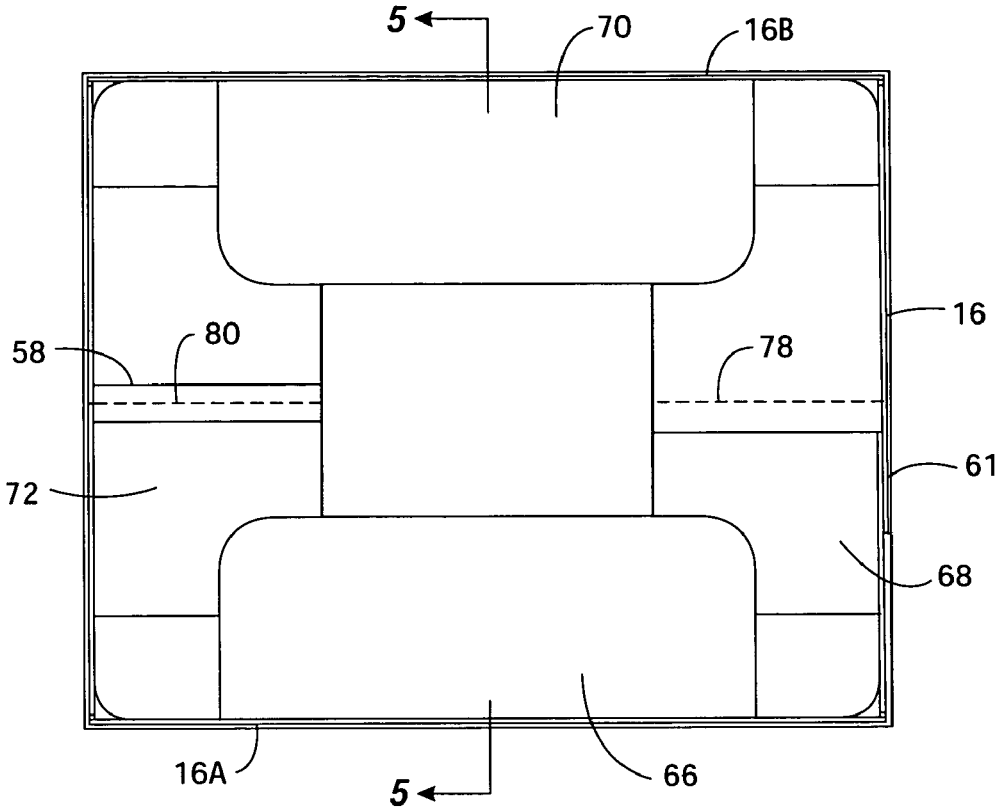
FIG. 4 is a top view of the inventive self-locking pallet assembly with the lid removed.
Figure 5:
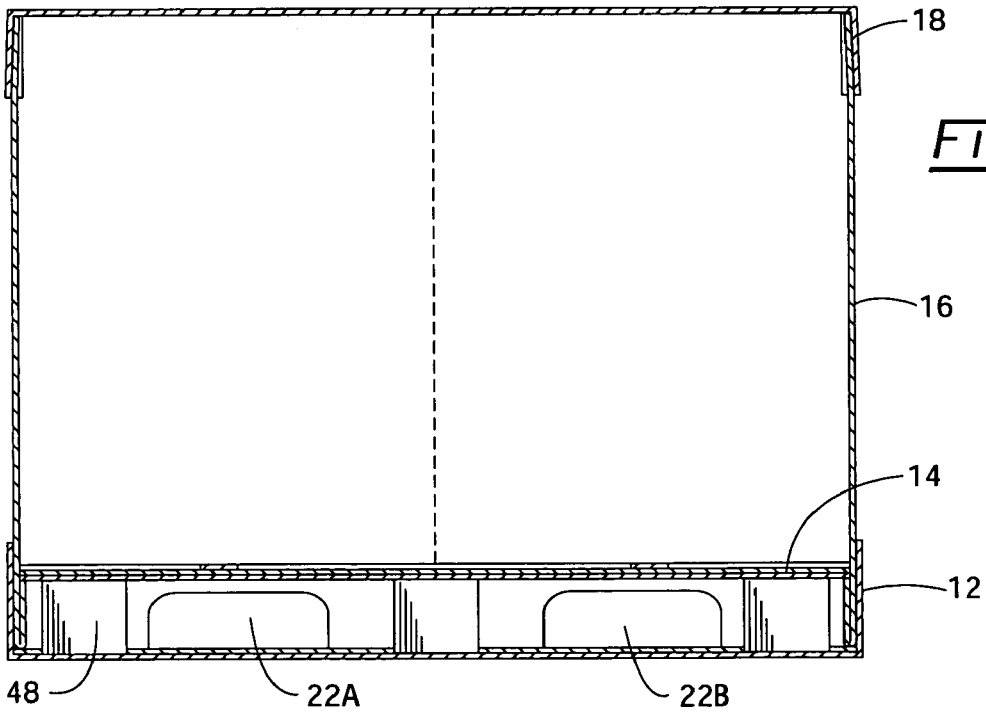
FIG. 5 is a sectional view taken along 5-5 of FIG. 4.

Referring now particularly to FIGS. 2 and 4, side unit 16 has projecting tabs, as represented by a tab, 56, which extends downwardly from sidewalls, 58, 60, 62, and 64. The projecting tabs mate with the recesses of floor unit 14, such as represented by tab and recess pair 56 and 52 (see FIG. 9 also). Additional tab/recess pairs are illustrated in the drawings with the number used being the same, more, or less than that shown in the drawings. The tab/recess pairs keep side unit 16 fixed and oriented with respect to base unit 12 and floor unit 14. The tabs stapled to the base unit after they are inserted, as at 44 in FIG. 2.

Side unit 16 is formed from two pieces of paperboard stock, as illustrated in the drawings; although, more of less pieces can be used in forming side unit 16, as is necessary, desirable, or convenient. As seen best in FIGS. 2 and 4, side unit 16 is formed from side unit piece 16A and 16B, which are fixed to each other at one pair of ends by tape, 58, and by adhesive applied to overlapping ends, as at item 61 (see FIG. 4). Other mans of attaching the side unit pieces 16A and 16B will be evident to those skilled in the art.

The projecting tabs, such as tab 56, are formed by die cutting each side unit piece. Additionally formed by such die cutting procedure are sections foldable to abut, such as, sections 66, 68, 70, and 72. Such sections rest atop floor unit 14 and urge side unit 16 in a self-standing state. Adhesive optionally can be applied to secure such sections to floor unit 14.

Figure 8:
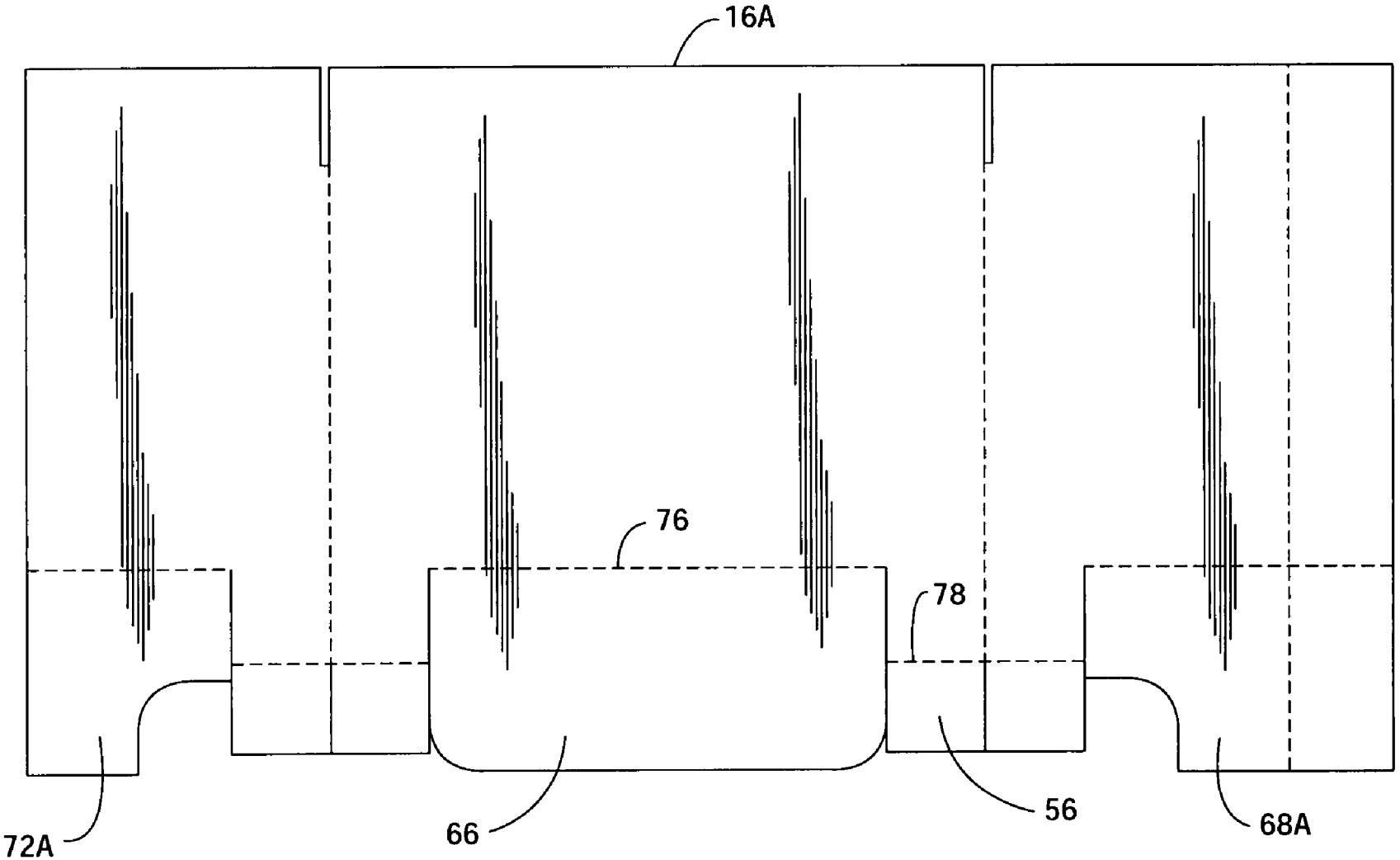
FIG. 8 is a plan view of the side of the carton in unfolded state showing fold lines in dotted form.

Side unit piece 16A is illustrated in FIG. 8 with side unit piece 16B being identical, but for its length being slightly greater to form overlap 60 (FIG. 4). Section 66 is formed by folding the paperboard along fold line 76. Tab 56 is formed by folding the paperboard along fold line 78. Section 68 is formed from section 68A and a corresponding section 68B, not shown in the drawings but part of side unit piece 16B. The same is true for section 72A. The fold lines for these sections also are illustrated in FIG. 8, but will not be referenced by item number as those skilled the art will be more than enabled to complete construction of side unit 16A by the disclosure herein.

Once side unit 16 has been assembled from side unit pieces 16A and 16B, the manufacturer can fold side unit 16 along fold lines 78 and 80 (FIG. 4) to collapse side unit 16, as depicted in FIGS. 6 and 7. Folded side unit 16, then, can be placed into the assembly of base unit 12 and floor unit 14. Lid 18, then, can be thereover to form the compact pallet assemblies, as seen in FIG. 6. By stacking several of these compacted assemblies atop each other, the manufacturer can ship many of the novel pallet assemblies for later assembly by the user.

The user by merely unfolding the compacted pallet assembly along fold lines 78 and 80 then can fold down sections 66, 68, 70, and 72, for placing atop floor unit 14. The rest of the assembly of pallet assembly 10, then, proceeds as described herein.

While the invention has been described with reference to various embodiments, those skilled in the art will understand that various changes may be made and equivalents may be substituted for elements thereof without departing from the scope and essence of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. In this application all units are in the metric system and all amounts and percentages are by weight, unless otherwise expressly indicated. Also, all citations referred herein are expressly incorporated herein by reference.

I claim:

1. A self-locking paperboard pallet assembly, which comprises:

(a) a base unit having leg receiving recesses and openings adapted to be filled with forks from a forklift for conveying of said paperboard pallet assembly;

(b) a rectilinear flat floor unit having downward projecting legs that mate with said base unit leg receiving recesses and having corner tab recesses;

(c) a self-supporting side unit of rectilinear configuration having an open top adapted to receive a lid, an open bottom, and four sidewalls; said sidewalls at said open bottom having projecting corner tabs for mating with said rectilinear flat floor unit corner tab recesses, said side unit having two longitudinal ends and having longitudinal fold lines adapted to be folded for forming said rectilinear configuration and to urge said side unit to be self-supporting; two opposing sidewalls of said side unit being foldable to collapse said side unit so that each non-folded sidewall can be laid down atop said flat floor unit for shipping and storage of said paperboard pallet assembly; and (d) a lid that covers the self-supporting side unit at its open top.

2. The self-locking paperboard pallet assembly of claim 1, wherein said base unit leg receiving recesses and said flat floor legs are rectilinear in shape.

3. A self-locking paperboard pallet assembly in compressed state suitable for shipping, which comprises:

(a) a base unit having leg receiving recesses and openings adapted to be filled with forks from a forklift for conveying of said paperboard pallet assembly;

(b) a rectilinear flat floor unit having downward projecting legs that mate with said base unit leg receiving recesses and having corner tab recesses;

(c) a self-supporting side unit in compressed state and disposed within said base unit for shipping, said self-supporting side unit when assembled having rectilinear configuration and having an open top adapted to receive a lid, an open bottom, and four sidewalls; said sidewalls at said open bottom having projecting corner tabs for mating with said floor unit corner tab recesses, said side unit having two longitudinal ends and having longitudinal fold lines adapted to be folded for forming said rectilinear configuration and to urge said side unit to be self-supporting; two opposing sidewalls of said side unit being folded to collapse said side unit so that each folded sidewall can be laid down atop said flat floor unit for shipping and storage of said paperboard pallet assembly; and (d) a lid that covers the compressed self-supporting side unit.

4. The self-locking paperboard pallet assembly in compressed state of claim 3, wherein said base unit leg receiving recesses and said flat floor legs are rectilinear in shape.

5. The self-locking paperboard pallet assembly in compressed state of claim 3, wherein a multiplicity of said assemblies is stacked atop each other for shipping.

* * * * *